United States Patent [19]

Linstromberg

[11] Patent Number: 4,741,169

[45] Date of Patent: May 3, 1988

[54] ICE MAKER SAFETY CONTROL

[75] Inventor: William J. Linstromberg, Lincoln Township, Berrien County, Mich.

[73] Assignee: Whirlpool Corporation, Benton Harbor, Mich.

[21] Appl. No.: 82,646

[22] Filed: Aug. 6, 1987

[51] Int. Cl.[4] ..... F25C 5/08

[52] U.S. Cl. ..... 62/135; 62/156; 62/351

[58] Field of Search ..... 62/156, 135, 73, 351

[56] References Cited

U.S. PATENT DOCUMENTS

| | | | |
|---|---|---|---|
| 2,717,500 | 9/1955 | Ploeger | 62/7 |
| 3,029,611 | 4/1962 | Kuhn | 62/156 |
| 3,228,204 | 1/1966 | Matthies | 62/140 |
| 3,276,225 | 10/1966 | Linstromberg | 62/353 |
| 3,373,575 | 3/1968 | Nelson | 62/80 |
| 3,495,416 | 2/1970 | Morrissey, Jr et al. | 62/155 |
| 3,631,685 | 1/1972 | Young | 62/158 |
| 3,726,105 | 4/1973 | Auracher | 62/156 |
| 3,803,862 | 4/1974 | Schumacher | 62/137 |
| 3,890,799 | 6/1975 | Sisk, Jr. | 62/215 |
| 3,899,895 | 8/1975 | Blanton et al. | 62/155 |
| 4,531,376 | 7/1985 | Alsenz | 62/156 |

*Primary Examiner*—William E. Tapolcai
*Attorney, Agent, or Firm*—Wood, Dalton, Phillips, Mason & Rowe

[57] ABSTRACT

An ice maker is provided with a safety control for preventing overheating of a mold. The mold is thermally coupled to a thermostat having a switch used for de-energizing a defrost heater which melts frost away from an evaporator. The ice maker is electrically connected with a switch of the defrost thermostat switch so that when the defrost thermostat senses the preselected high temperature of the mold, the ice maker is de-energized to prevent overheating of the mold.

19 Claims, 2 Drawing Sheets

FIG. 1
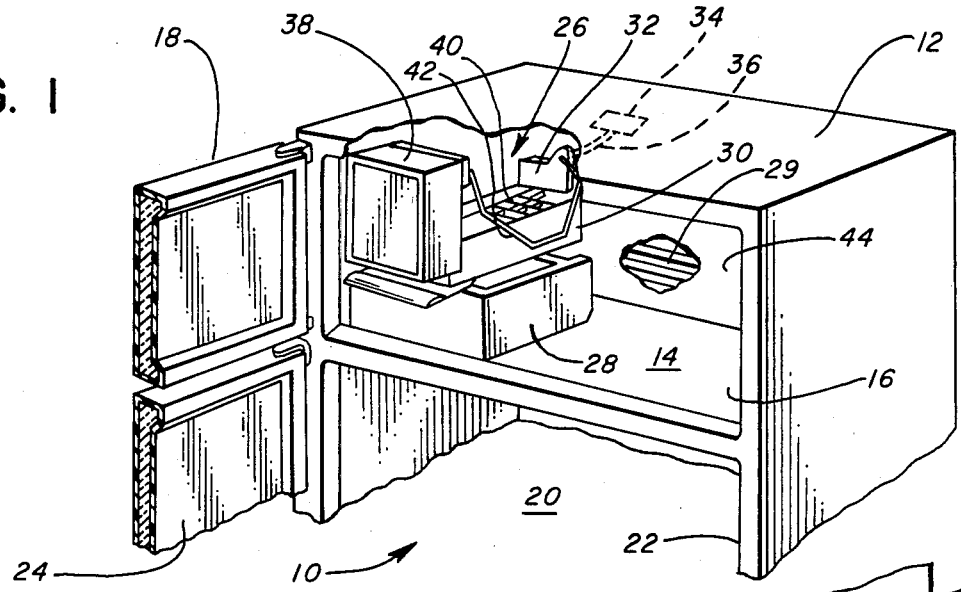
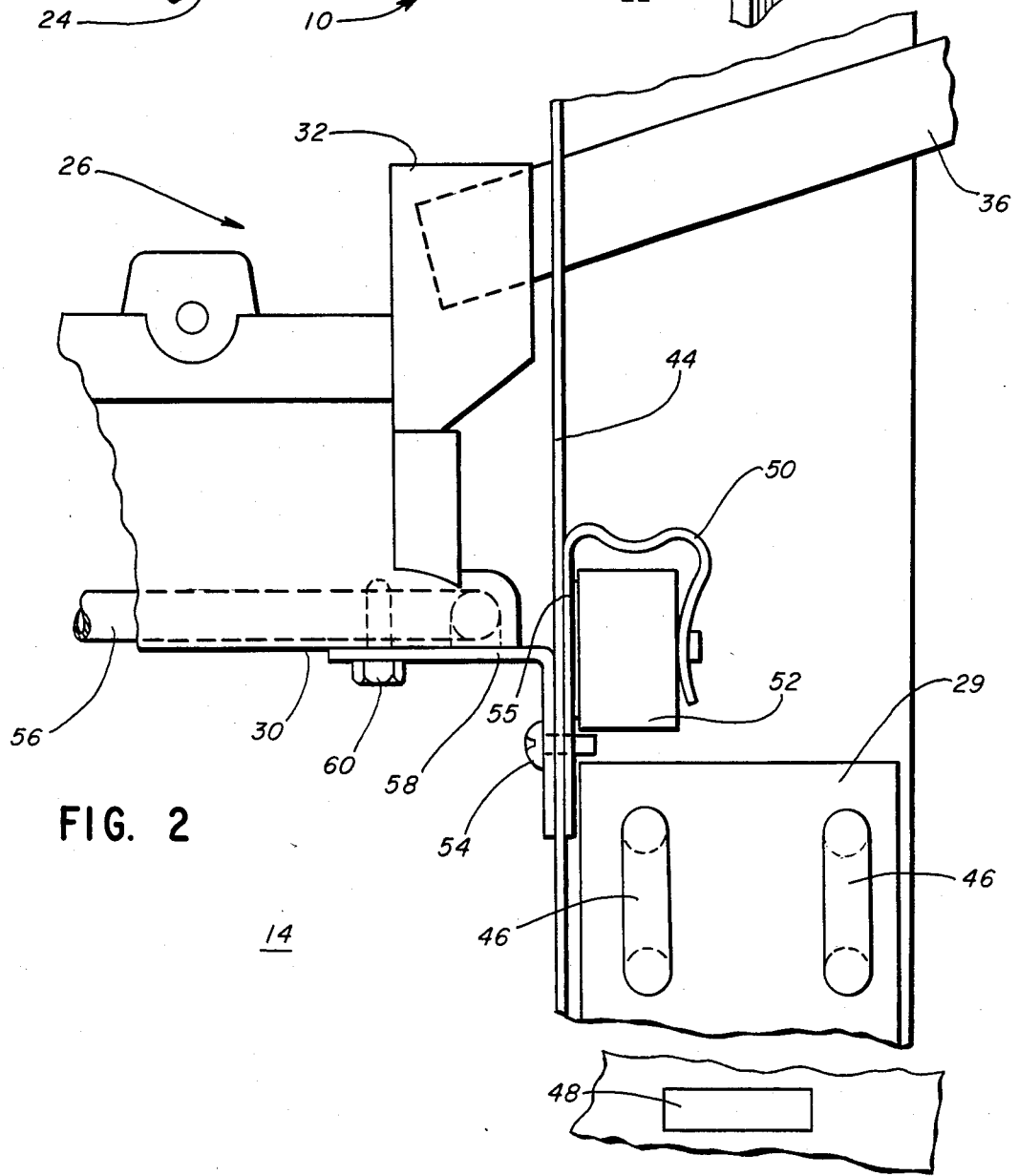
FIG. 2

FIG. 3
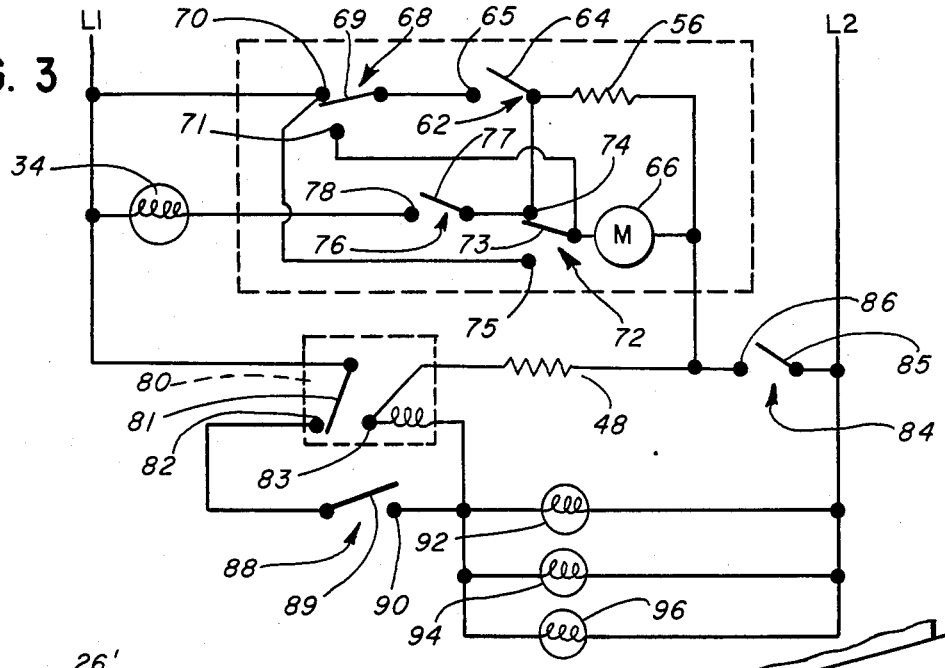
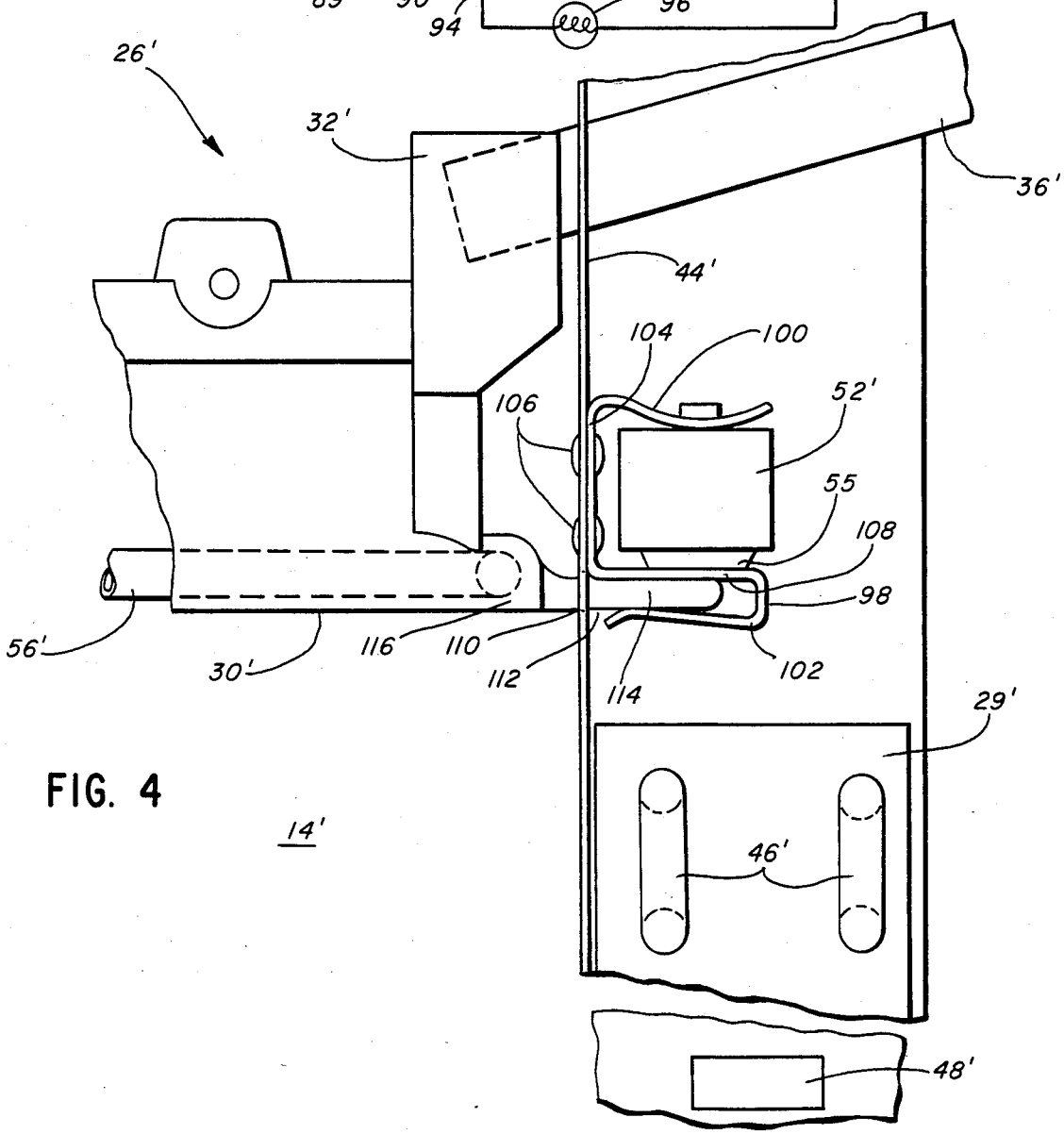
FIG. 4

ICE MAKER SAFETY CONTROL

BACKGROUND OF THE INVENTION

1. Field of the Invention

This invention relates generally to ice makers, and more particularly, to a safety control for an ice maker used in domestic refrigerators and the like.

2. Description of Background Art

In one form of an ice maker, an ice mold and associated mechanism are mounted in the freezer compartment of a domestic refrigerator/freezer. One example of such an ice maker is illustrated in Linstromberg U.S. Pat. No. 3,276,225, which is owned by the assignee of the present invention. Such ice makers are provided with resistance heaters for heating the mold upon completion of the forming of the ice bodies therein so as to permit freeing of the ice bodies therefrom for dispensing automatically to a subjacent collecting bin. A thermostat in heat transfer association with the mold senses when the ice bodies are sufficiently frozen and thereafter initiates an ejection cycle wherein the mold heater is energized. After the ice bodies have been removed from the mold, the thermostat is reset as the mold heats up, at which time the mold heater is de-energized.

If the thermostat fails, leaving the mold heater energized for an extended period of time, the refrigerator/-freezer could suffer extensive damage. Damage is particularly likely in a refrigerator/freezer utilizing a plastic liner or a smaller compressor which cannot remove heat at a fast rate.

Certain ice makers, such as described in Ploeger U.S. Pat. No. 2,717,500, utilize a high temperature limit switch in series with the mold heater. The limit switch is operable to shut off the heater when the mold reaches an undesirably high temperature. However, such a construction requires that two thermostat switches be provided with the ice maker, increasing the cost and complexity thereof.

The present invention overcomes the above problems of prior art ice makers in a novel and simple manner.

SUMMARY OF THE INVENTION

In accordance with the present invention, an ice maker is provided which utilizes a defrost thermostat in a safety control for the ice maker.

Broadly, there is disclosed herein a refrigeration apparatus which includes an evaporator and a defrost heater for defrosting the evaporator when frost is formed thereon. A defrost heater at a preselected high temperature of the evaporator after the frost has been sufficiently melted therefrom. The refrigeration apparatus also includes an ice making apparatus having a mold, a mold heater and a control circuit for controllably energizing the mold heater to release ice bodies from the mold. A safety control for the ice making apparatus includes means for thermally coupling the defrost thermostat with the mold. Means are provided electrically connecting the defrost thermostat switch with the control circuit for de-energizing the mold heater at a preselected high temperature of the mold to prevent overheating thereof.

The defrost thermostat is mounted to an evaporator cover plate at a level above the evaporator. Moreover, the precise positioning of the defrost thermostat is determined so that it is in close proximity to a conventional position for an ice making apparatus in a freezer compartment.

The present invention in one embodiment comprehends the use of a heat conducting bracket fastened at one end to the mold and at its other end to the evaporator cover and a retaining clip for the defrost thermostat.

In another form of the invention, the mold is provided with a heat conducting probe extending therefrom. The mold is received in an engaging member forming part of the retaining clip for the defrost thermostat.

It is another object of the present invention to provide a field installable ice maker including the safety control of the present invention.

It is a further object of the present invention to provide a safety control operable to shut off the ice maker whenever the defrost thermostat senses a preselected high temperature.

Further features and advantages of the invention will readily be apparent from the specification and from the drawings.

BRIEF DESCRIPTION OF THE DRAWINGS

FIG. 1 is a fragmentary, perspective view of a refrigeration apparatus having an ice maker safety control embodying the invention;

FIG. 2 is a fragmentary, elevation view of an ice mold and associated evaporator structure;

FIG. 3 is a schematic electrical wiring diagram illustrating control circuitry for the refrigeration apparatus; and FIG. 4 is a fragmentary, elevational view of an ice mold and associated evaporator structure for an alternative embodiment of the invention.

DESCRIPTION OF THE PREFERRED EMBODIMENTS

In one embodiment of the invention as disclosed in FIGS. 1 and 2, a refrigeration apparatus 10 includes an insulated cabinet 12 defining a below-freezing, or freezer, compartment 14 having a front opening 16 selectively closed by a freezer door 18. The cabinet 12 further includes an above-freezing, or fresh food, compartment 20 having a front opening 22 selectively closed by a second door 24. An ice making apparatus 26 is disposed within the freezer compartment 14 for forming ice bodies and delivering them to a subjacent collecting bin 28 also disposed within the freezer compartment 14. The compartments 14 and 20 are refrigerated by a suitable evaporator 29 disposed within the walls of the cabinets 12. The evaporator 29 forms a portion of a conventional refrigeration circuit including connected components, such as a compressor, condenser, capillary and conduit (not shown) for delivering the refrigerant to and from the evaporator.

The ice maker 26 includes a mold 30 in which ice bodies are formed, water being delivered to the mold 30 by an inlet 32 connected to a solenoid operated valve 34 by a delivery tube 36. The solenoid valve 34 may be connected to a suitable source of water under pressure (not shown). The ice maker 26 further includes a control 38 disposed at the front end of the mold 30 and arranged to operate an ejector blade 40 which, upon completion of the freezing of the ice bodies in the mold 30, removes the ice bodies from the mold 30 to the subjacent collecting bin 28. A pivotally mounted sensing arm 42 extends downwardly above the collecting bin 28 to sense the level of ice bodies therein.

Referring particularly to FIG. 2, the evaporator 29 is mounted rearwardly with respect to an evaporator cover 44 defining a rear wall of the freezer compartment 14. The evaporator cover 44 is of metal construction and is in heat transfer association with the evaporator 29. In normal refrigeration operation, frost builds up on coils 46 of the evaporator 29. A suitable defrost heater 48 is mounted below the evaporator 29. The defrost heater 48 is controllably energized, as is described in greater detail below, to melt the frost which accumulates on the evaporator coils 46. A thermostat mounting clip 50 resiliently embraces a defrost thermostat 52 in heat transfer association with the evaporator cover 44, and, thus, evaporator 29. The clip 50 is substantially U-shaped and is constructed of aluminum. The clip 50 is secured to the evaporator cover 44 by, for example, a screw 54. The defrost thermostat 52 is typically a bimetal sensor having a sensing surface 55 for sensing temperature, and a switch, described below, which opens when the sensed temperature exceeds a preselected high temperature. The sensing surface 55 is in facial contact with the clip 50, which, in turn, is in facial contact with the evaporator cover 44. Accordingly, the thermostat 52 senses the temperature of the metal cover 44 above the evaporator 29. The thermostat 52 is operable to de-energize the defrost heater at the preselected high temperature to insure that substantially all of the frost has been melted from the evaporator coils 46.

The ice making apparatus 26 is similar to that described in copending Chesnut et al. U.S. patent application Ser. No. 081,871, assigned to the assignee of the present invention, the specification of which is hereby incorporated by reference. The mold 30 receives water from the inlet 32 and includes partition walls (not shown) defining a plurality of cavities in which corresponding plurality of ice bodies are formed. The removal of ice bodies from the mold cavities is facilitated by means of a resistance heater element 56 extending through the mold 30 on the underside thereof. The heater 56 warms the mold sufficiently to melt the surface of the ice bodies engaging the walls of the mold cavities and thereby free the ice bodies for ejection from the cavities by the ejector blade 40.

An L-shaped bracket 58 of heat conducting material is secured to the evaporator cover 44 and the clip 50 with the screw 54. A second screw 60 fastens the bracket 58 to the mold 30. Accordingly, the bracket 58 comprises a body which conducts heat from the mold 30 to the sensing surface 55 of the defrost thermostat 52.

A schematic electrical wiring diagram for control circuitry 61 of the refrigeration apparatus 10 is illustrated in FIG. 3. Particularly, the ice maker control 38 for the ice making apparatus 26 includes a thermostat (not shown) in heat transfer association with the mold 30. The thermostat comprises a bimetal device including a switch 62 having a movable contact 64 and a fixed contact 65. The bimetal of the mold thermostat is operable to move the movable contact 64 in electrical contact with the fixed contact 65 when the sensed temperature of the mold is below a preselected temperature on the order of 15° F., and to reset, by breaking contact, between movable contact 54 and the fixed contact 55 at a preselected temperature on the order of 32° F.

The control 38 further includes a motor 66 which rotates a shaft carrying the ejector blade 40 and a cam (not shown). The cam includes structure which is operable for controlling the sensing arm 42 to operate a shutoff switch 68. The shutoff switch 68 has a movable contact 69 and a pair of fixed contacts 70 and 71. The shutoff switch 68 is biased to engage its moving contact 69 with the fixed contact 70 when the sensing arm 42 is in the position shown in FIG. 1. The control 38 further includes a holding switch 72 having a movable contact 73 selectively engageable with a first fixed contact 74 and a second fixed contact 75. The holding switch 72 is operated according to the rotational position of the cam. A water valve switch 76, also controlled by the cam, has a movable contact 77 and a fixed contact 78.

The defrost heater 48 is controllably energized by a defrost timer 80. The defrost timer 80 includes a movable contact 81 and fixed contacts 82 and 83. Additionally, the defrost heater 48 is de-energized by a defrost thermostat switch 84 of the defrost thermostat 52. The switch 84 includes a movable contact 85 and a fixed contact 86. The movable contact 85 is away from the fixed contact 86 when the temperature sensed by the defrost thermostat 52 is above a preselected high temperature.

A cabinet thermostat switch 88 includes a movable contact 89 and a fixed contact 90. The cabinet thermostat switch 88 controllably energizes a compressor 92, an evaporator fan 94 and a condenser fan 96 to provide refrigerated air which is circulated through the compartments 14 and 20.

The operation of the control 38 is as follows. Assuming that the mold contains a quantity of water in the process of being frozen to form ice bodies and the level of the ice bodies in the collecting bin 28 is below the preselected full level, the mold thermostat senses a relatively warm condition whereby the switch 62 is in the open position, as shown in FIG. 3. Further, the shutoff switch 68 has its movable contact 69 in contact with the fixed contact 70, the holding switch 72 has its movable contact 73 in contact with the fixed contact 74, and the water valve switch 76 has its movable contact 77 spaced from its fixed contact 78. Thus, the control 38 is in a de-energized condition between power supply leads L1 and L2.

During the normal refrigeration operation, the evaporator is below a preselected low temperature, causing the defrost thermostat switch 84 to be closed with its movable contact 85 engaging fixed contact 86.

As described above, the mold thermostat is arranged to have a cut in temperature of 15° F. and a reset or cut out temperature of 32° F. Thus, when the water in the mold becomes completely frozen and the temperature thereof drops to 15° F., the thermostat switch 62 is operated to close its movable contact 64 with its fixed contact 65, thereby establishing a circuit from power supply to lead L1 through contacts 70 and 69 of the shutoff switch 68, contacts 64 and 65 of the thermostat switch 62, and through the heater 56, the contacts 85 and 86 of the defrost thermostat switch 84 to lead L2. At the same time, the control motor 66 is energized from contact 64 through the movable contact 73 and the fixed contact 74 of the holding switch 72. This causes the cam to rotate responsive to movement of the motor. After a small amount of rotation, the holding switch 72 breaks contact between its movable contact 73 and fixed contact 74 and makes contact between the movable contact 73 and the fixed contact 75, thereby establishing a holding circuit from lead L1, through contacts 75 and 73 to motor 66 whereby the motor 66 is energized regardless of the condition of the thermostat switch 62.

An additional amount of rotation causes the sensing arm 42 to swing upwardly from the collecting bin 28. At the same time, the shutoff switch breaks contact between its movable contact 69 and its fixed contact 70 and makes an electrical contact between its movable contact 69 and its other fixed contact 71. This establishes a circuit to the heater 56 from lead L1 through contacts 75 and 73 of the holding switch 72, contacts 71 and 69 of the shutoff switch 68 and contacts 65 and 64 of the mold thermostat switch 62. Thus, the control motor 66 is energized independently of the thermostat switch 62, while the heater 56 is energized under the control of the thermostat switch 62 at this time.

The operation of the motor 66 causes rotation of the ejector blade 40 until it engages the ice bodies within the mold cavity. In the event the ice bodies have not been freed from the mold, the motor 66 stalls until such time as the mold heater 56 melts the ice bodies free. The motor then continues rotation of the ejector blade 40 to move the ice bodies from the cavities. At the same time, the sensing arm 42 is lowered into the collecting bin 28. If the level of the ice bodies collected in the bin 28 is below the preselected level, arm 42 moves downwardly into the bin 28 and allows the movable contact 69 of the shutoff switch 68 to become repositioned with the movable contact 69 spaced from the fixed contact 71 and engaging the fixed contact 70.

Prior to 180° rotation of the ejector blade 40, the heater 56 will have heated the mold sufficiently, i.e. 32° F., to reset the mold thermostat and accordingly open the thermostat switch 62 by moving its movable contact 64 away from its fixed contact 65, thus de-energizing heater 56. Prior to the ejector blades completing a revolution, the movable contact 77 of the water valve switch 76 makes an electrical contact with its fixed contact 78 to admit water through the inlet 32 into the mold 30 for forming a subsequent group of ice bodies therein. After a preselected period of time, the water valve switch 76 opens by breaking contact between movable contact 77 and its fixed contact 78, thereby terminating the flow of water to mold 30. The completion of the control cycle occurs upon a small additional operation of the motor 66 whereby the movable contact 73 of the holding switch 72 is spaced from its fixed contact 75 and engages the other fixed contact 74. The control 38 is now fully de-energized at the beginning of the operation cycle, as discussed above, whereby a subsequent cycle may become initiated by the complete freezing of the ice bodies in the mold.

When a sufficient number of ice bodies have been delivered to the collecting bin 28 so as to cause the level therein to rise to a preselected full level, the operation of the ice maker control 38, as discussed above, is interrupted by preventing the sensing arm 42 from lowering into the bin 28. Thus, the movable contact 69 of the shutoff switch 68 remains in engagement with its fixed contact 71 and the circuit remains broken between the contacts 69 and 70. This condition remains until such time as the level of ice bodies in the bin is lowered as by removing some or all of the ice bodies therein. When this occurs, the release of the sensing arm 42 allows the switch to close movable contact 69 with fixed contact 70 and permits the subsequent operation of the control 38, as discussed above. It should be noted that the cycle is always completed before termination of operation of control 38.

The remainder of the control 61 is operable to perform the normal refrigeration functions of the refrigeration apparatus 10. Particularly, the defrost timer 80 normally has its movable contact 81 in engagement with the fixed contact 82, whereby the cabinet thermostat switch 88 simultaneously controls the compressor 92, the evaporator fan 94, and the condenser fan 96, when the cabinet thermostat senses a temperature above a preselected level. Upon the completion of a preselected time passing from a previous defrost cycle, the movable contact 81 of the defrost timer 80 breaks contact with the fixed contact 82 and makes contact with the fixed contact 83. Normally, the defrost thermostat switch 84, due to the relatively low temperature of the evaporator caused by the refrigeration operation and the frost on the evaporator coils, has its movable contact 85 in electrical contact with its fixed contact 86. Therefore, a complete circuit from L1 through contacts 81 and 83 of the defrost timer 80 and through contacts 85 and 86 of the defrost thermostat 84 to lead L2 causes the defrost heater 48 to energize to melt the frost from the evaporator 40. When the thermostat switch 84 opens upon sensing a preselected high temperature of the evaporator 40, the movable contact 85 breaks with the fixed contact 86, thereby de-energizing the defrost heater 48. The defrost cycle is completed when timer contact 81 closes with contact 82.

In the event that the mold thermostat switch 62 fails to de-energize the mold heater 56 due to a failure thereof during an ice harvesting operation, or under a short circuit condition, the mold heater 56 continues to heat up to an undesirably elevated temperature. Heat from the mold 30 is conducted therefrom through the L-shaped bracket 58 to the defrost thermostat 52, causing the defrost thermostat 52 to sense a preselected high temperature, thus causing its movable contact 85 to break contact with the fixed contact 86, thus de-energizing the ice maker control circuit 38 including the mold heater 56. The ice maker remains de-energized until the defrost thermostat resets upon cooling of the mold 30. Accordingly, the defrost thermostat 52 and its associated switch 84 provide a safety control for the ice maker control 38 to prevent overheating of the mold 30.

As is evident from the above, a cost savings results from having the defrost thermostat perform the dual functions of de-energizing the defrost heater 48 at the completion of the defrost cycle and acting as a safety switch for the ice maker 26.

An alternative embodiment of the present invention is illustrated in FIG. 4 wherein like components are indicated with primed reference numerals.

A thermostat clip 98 is substantially S-shaped with an upper portion 100 of the S-shape being enlarged with respect to a lower portion 102 thereof. A sidewall 104 of the upper portion 100 is secured by any known means, such as rivets 106, to the evaporator cover 44'. The upper and lower portions 100 and 102 are substantially U-shaped and include a common wall 108. An aperture 110 is provided in the evaporator cover 44' in alignment with an open end 112 of the lower portion 102 of the thermostat clip 98. The clip upper portion 100 resiliently embraces the thermostat 52' with the sensing surface 55' thereof in facial contact with the common wall 108.

The mold 30' includes an elongated heat conducting probe 114 extending outwardly from an end 116 closest to the evaporator cover 44'. When the ice making apparatus 26' is installed in a freezer compartment 14', the probe 114 extends through the opening 110 in the evaporator cover 44', into the open end portion 112 of the clip 98. The U-shaped clip lower portion 102 thus resiliently embraces the probe 114 in heat transfer association with the common wall 108 and the sensing surface wall 55' of the thermostat 52'. Accordingly, a thermoconducting path is provided from the mold 30' to the clip 98 and, thus, the defrost thermostat 52'.

An electrical circuit similar to that illustrated in FIG. 3 is utilized in conjunction with the alternative embodiment and functions in the same manner as described above, with the only difference being the particular thermoconducting path from the mold 30' to the defrost thermostat 52'.

The ice making apparatus 26' of the alternative embodiment is particularly applicable to instances where it is intended for an ice making apparatus to be field installed in an existing refrigerator/freezer. The refrigerator/freezer must be provided with the S-shaped clip 98 located as shown in FIG. 4, with an appropriate aperture 110 provided in the evaporator cover 44'. A suitable plug or cover (not shown) can be provided for the aperture 110 when the refrigerator/freezer is manufactured and sold. When a purchaser desires to install such an ice maker 26', the plug need only be removed when the ice making apparatus 26' is installed in the freezer compartment 14' with the probe 114 being inserted through the opening 110 into the clip 98, as discussed above.

In all other respects, the operation of the ice maker according to the alternative embodiment of the invention is identical to that discussed above and, therefore, is not discussed in detail herein.

Thus, the invention broadly comprehends an ice maker which provides a safety control for a mold heater utilizing an existing defrost thermostat in the refrigerator/freezer.

The foregoing disclosure of the preferred embodiments is illustrative of the broad inventive concepts comprehended by the invention.

I claim:

1. In a refrigeration apparatus including an evaporator, a defrost heater for defrosting said evaporator, a defrost thermostat having a switch for de-energizing said defrost heater at a preselected high temperature of the evaporator, and an ice making apparatus having a mold, a mold heater, and a control circuit controllably energizing said mold heater, a safety control for said ice making apparatus comprising:

means for thermally coupling said defrost thermostat with said mold; and means electrically connecting said defrost thermostat switch with said control circuit for de-energizing said mold heater at a preselected high temperature of the mold to prevent overheating thereof.

2. The safety control of claim 1 wherein said coupling means comprises a bracket of thermal conductive material in heat transfer association with said mold and said defrost thermostat.

3. The safety control of claim 1 wherein a clip retains said thermostat in engagement with an evaporator cover in heat transfer association with said evaporator.

4. The safety control of claim 3 wherein said coupling means comprises a bracket of thermal conductive material having a first end fastened to said mold and a second end fastened to said clip so that heat from said mold is conducted through said bracket to said defrost thermostat.

5. The safety control of claim 1 wherein said mold includes an elongated probe extending outwardly therefrom in heat transfer association with said defrost thermostat.

6. The safety control of claim 5 wherein a retaining clip resiliently embraces said defrost thermostat above said evaporator in heat transfer association therewith.

7. The safety control of claim 6 wherein said clip is fastened to a heat conductive evaporator cover disposed forwardly of said evaporator.

8. The safety control of claim 7 wherein said evaporator cover includes an aperture in alignment with said fastened clip and said probe extends through said aperture with said clip resiliently embracing said probe so that heat is conducted from said mold to said defrost thermostat.

9. In a refrigeration apparatus including an evaporator, a defrost heater for defrosting said evaporator, a defrost thermostat having a switch for de-energizing said defrost heater at a preselected high temperature of the evaporator, and an ice making apparatus having a mold, a mold heater, and a control circuit controllably energizing said mold heater, a safety control for said ice making apparatus comprising:

thermoconducting means for conducting heat from said mold to said defrost thermostat; and means electrically connecting said defrost thermostat switch with said control circuit for de-energizing said mold heater at a preselected high temperature of the mold to prevent overheating thereof.

10. The safety control of claim 9 wherein said conducting means comprises a body of thermal conductive material in heat transfer association with said mold and said defrost thermostat.

11. The safety control of claim 9 wherein a spring metal clip fastened to an evaporator cover resiliently embraces said thermostat switch in heat transfer association with said evaporator.

12. The safety control of claim 11 wherein said conducting means comprises a body of thermal conductive material having one end fastened to said mold and another end fastened to said spring clip so that heat from said mold is conducted through said bracket to said defrost thermostat.

13. The safety control of claim 9 wherein said conducting means comprises an elongated probe extending outwardly from said mold, and in thermal contact with said defrost thermostat.

14. The safety control of claim 13 wherein a spring metal clip resiliently embraces said defrost thermostat to an evaporator cover in heat transfer association with said evaporator.

15. The safety control of claim 14 wherein said clip includes a U-shaped portion resiliently embracing said thermostat.

16. The safety control of claim 15 wherein said evaporator cover includes an aperture in alignment with another U-shaped portion of said clip and said probe extends through said aperture wherein said other U-shaped portion resiliently embraces said probe so that heat is conducted from said mold to said defrost thermostat.

17. An ice making apparatus for use in a refrigeration apparatus including a defrost thermostat having a switch, comprising:

a mold in which water is frozen to form an ice body;

means for ejecting the ice bodies from the mold;

controllably energizable means for heating the mold to free the ice bodies from the mold;

control circuit means for controllably energizing said heating means;

means for thermally coupling said mold with said defrost thermostat; and means for electrically connecting said control circuit means with said defrost thermostat switch for de-energizing said heating means at a preselected high temperature of the mold to prevent overheating thereof.

18. The safety control of claim 17 wherein said coupling means comprises an elongated probe extending outwardly from said mold.

19. An ice making apparatus for use in a refrigeration apparatus including a defrost thermostat having a switch, comprising:

a mold in which water is frozen to form an ice body;

an electric heater in heat transfer association with said mold for freeing the ice bodies from the mold;

a heat conducting probe extending outwardly from said mold so that when said ice making apparatus is mounted in said refrigeration apparatus said probe is in thermal contact with said defrost thermostat to conduct heat from said mold to said defrost thermostat; and means for electrically connecting said heating means with said defrost thermostat switch for de-energizing said heating means at a preselected high temperature of the mold to prevent overheating thereof.

* * * * *